US009394913B2

(12) United States Patent
Taguchi et al.

(10) Patent No.: US 9,394,913 B2
(45) Date of Patent: Jul. 19, 2016

(54) CENTRIFUGAL COMPRESSOR

(71) Applicant: Panasonic Corporation, Kadoma-shi, Osaka (JP)

(72) Inventors: Hidetoshi Taguchi, Osaka (JP); Fumitoshi Nishiwaki, Hyogo (JP); Kou Komori, Nara (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 282 days.

(21) Appl. No.: 14/126,311

(22) PCT Filed: Mar. 22, 2013

(86) PCT No.: PCT/JP2013/001968

§ 371 (c)(1),
(2) Date: Dec. 13, 2013

(87) PCT Pub. No.: WO2013/140819

PCT Pub. Date: Sep. 26, 2013

(65) Prior Publication Data

US 2014/0202202 A1 Jul. 24, 2014

(30) Foreign Application Priority Data

Mar. 22, 2012 (JP) ..... 2012-065933

(51) Int. Cl.
*F04D 27/02* (2006.01)
*F04D 29/68* (2006.01)
(Continued)

(52) U.S. Cl.
CPC ..... *F04D 27/0215* (2013.01); *F04D 29/4213* (2013.01); *F04D 29/682* (2013.01);
(Continued)

(58) Field of Classification Search
CPC ..... F04D 27/0215; F04D 29/4213; F04D 29/682; F04D 27/023; F04D 29/44; F25B 2400/16; F25B 2400/072; F25B 43/006; F25B 41/003; F25B 1/053; F25B 1/10
See application file for complete search history.

(56) References Cited

U.S. PATENT DOCUMENTS 4,248,566 A * 2/1981 Chapman ..... F04D 27/0215 415/26
4,930,978 A * 6/1990 Khanna ..... F04D 27/0207 415/58.3

(Continued)

FOREIGN PATENT DOCUMENTS

CN 101896778 11/2010
CN 102388279 3/2012

(Continued)

OTHER PUBLICATIONS

Search Report issued in corresponding Chinese Patent Application No. 201380001726.0, Nov. 19, 2015, 4 Sages with an English translation.

*Primary Examiner* — Emmanuel Duke
(74) *Attorney, Agent, or Firm* — Hamre, Schumann, Mueller & Larson, P.C.

(57) ABSTRACT

A centrifugal compressor includes: an impeller having full blades and splitter blades; a shroud wall forming an intake and having a shape conforming to the impeller; and a bleed chamber facing an outer surface of the shroud wall. The bleed chamber communicates with a discharge space having a pressure equal to or lower than a pressure of a working fluid at the intake. The shroud wall is provided with a slit (a bleeding passage) that directs a portion of the working fluid that has flowed into a space between the full
blade and a pressurizing surface of the splitter blade to the bleed chamber.

11 Claims, 7 Drawing Sheets

(51) Int. Cl.

| | |
|---|---|
| ***F04D 29/42*** | (2006.01) |
| *F25B 1/053* | (2006.01) |
| *F25B 1/10* | (2006.01) |
| *F25B 41/00* | (2006.01) |
| *F25B 43/00* | (2006.01) |

(52) U.S. Cl.

CPC ..... *F04D27/023* (2013.01); *F25B 1/053* (2013.01); *F25B 1/10* (2013.01); *F25B 41/003* (2013.01); *F25B 43/006* (2013.01); *F25B 2400/072* (2013.01); *F25B 2400/16* (2013.01)

(56) References Cited

U.S. PATENT DOCUMENTS

2006/0088412 A1* 4/2006 Barton ..... F01D 5/26 415/206
2008/0053127 A1* 3/2008 Takahashi ..... F01K 3/006 62/238.7
2009/0013689 A1 1/2009 Sumser et al.
2009/0095001 A1* 4/2009 Imai ..... F25B 19/04 62/196.3
2010/0287969 A1 11/2010 Ueda et al.
2011/0088392 A1 4/2011 Sumser et al.
2012/0321440 A1 12/2012 Zheng et al.

FOREIGN PATENT DOCUMENTS

| | | |
|---|---|---|
| JP | 2-136598 | 5/1990 |
| JP | 4100030 | 6/2008 |
| JP | 2009-257177 | 11/2009 |
| WO | 03/095908 | 11/2003 |
| WO | 2007/093367 | 8/2007 |
| WO | 2007/111595 | 10/2007 |
| WO | 2010/031499 | 3/2010 |
| WO | 2010/117973 | 10/2010 |
| WO | 2011/099418 | 8/2011 |

* cited by examiner

CENTRIFUGAL COMPRESSOR

TECHNICAL FIELD

The present invention relates to a centrifugal compressor.

BACKGROUND ART

Conventionally, a centrifugal compressor configured to return a portion of a working fluid that passes through an impeller to an intake is known. For example, Patent Literature 1 discloses a centrifugal compressor 100 as shown in FIG. 7.

In this centrifugal compressor 100, a cylindrical treatment chamber 130 is provided in a shroud wall 120 surrounding an impeller 110. A slit-like first flow path 131 opens towards the impeller 110 at one end of the treatment chamber 130, and a slit-like second flow path 132 opens into an intake 101 at the other end of the treatment chamber 130.

CITATION LIST

Patent Literature

Patent Literature 1: JP 4100030 B

SUMMARY OF INVENTION

Technical Problem

Even if the configuration as described above is employed in a centrifugal compressor, there is still a lot of room for improvement in the performance of the compressor.

In view of this, it is an object of the present invention to enhance the performance of a centrifugal compressor.

Solution to Problem

The present disclosure provides a centrifugal compressor that compresses a working fluid, including: an impeller having alternately arranged full blades and splitter blades, the splitter blades being shorter than the full blades; a shroud wall forming an intake and having a shape conforming to the impeller; and a bleed chamber that communicates with a discharge space having a pressure equal to or lower than a pressure of the working fluid at the intake, the bleed chamber facing an outer surface of the shroud wall, wherein the shroud wall is provided with a bleeding passage that directs a portion of the working fluid that has flowed into a space between the full blade and a pressurizing surface of the splitter blade to the bleed chamber, and in a meridional projection obtained by rotationally projecting the full blade, the splitter blade, and the shroud wall on a meridian plane passing through a rotational axis of the impeller, a point of intersection of an upstream edge of the splitter blade and an outward edge of the splitter blade is located at a position closer to the intake than an intake-side edge of an opening of an inlet of the bleeding passage.

Advantageous Effects of Invention

According to the present disclosure, it is possible to enhance the performance of the centrifugal compressor.

BRIEF DESCRIPTION OF DRAWINGS

FIG. 5 is used.

DESCRIPTION OF EMBODIMENTS

Figure 1:
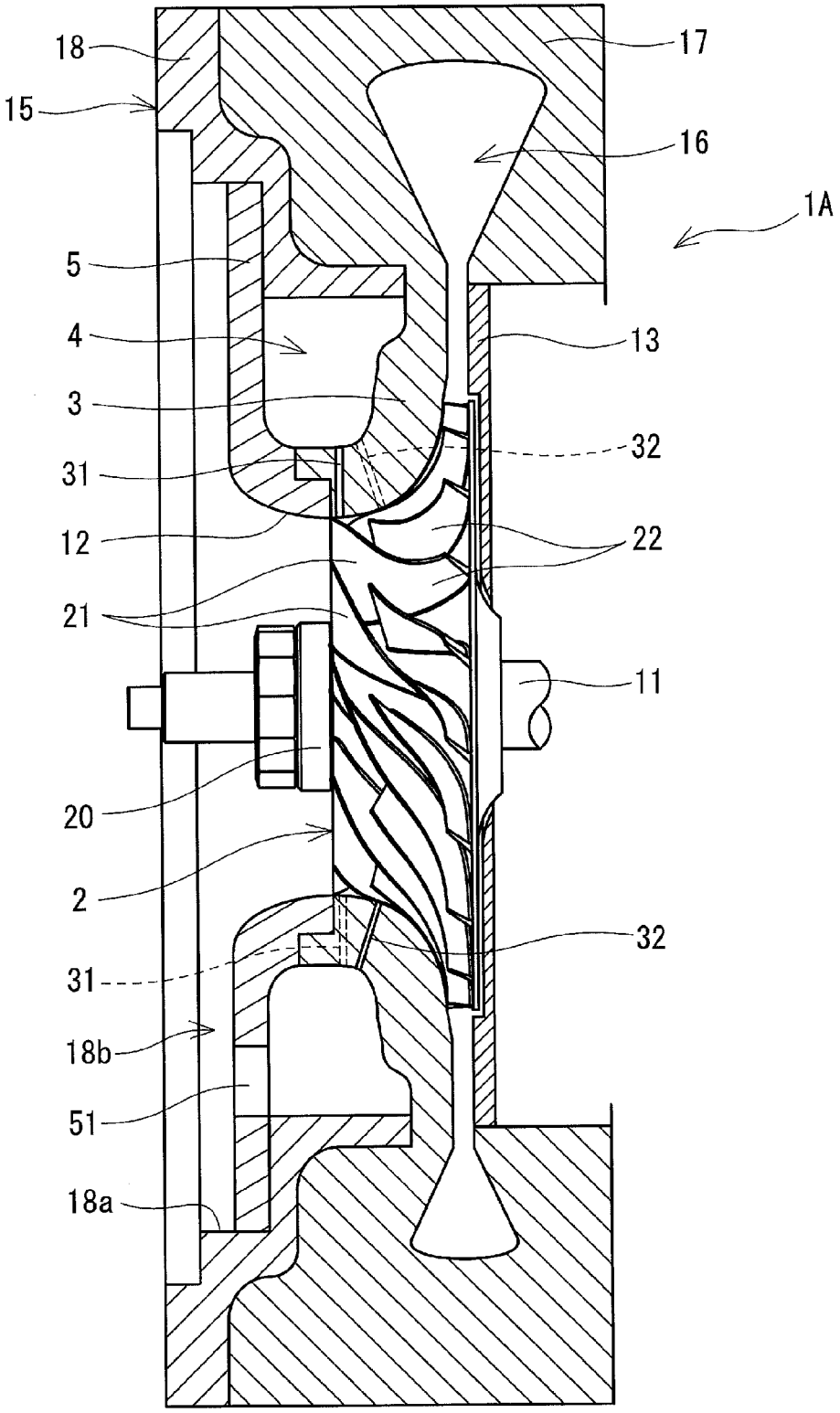
FIG. 1 is a cross-sectional view of a centrifugal compressor according to an embodiment of the present disclosure.

First, the focus of the present disclosure is described.

An impeller of a centrifugal compressor typically has a configuration in which full blades and splitter blades shorter than the full blades are alternately arranged. A working fluid drawn into the centrifugal compressor first flows into the space between the full blades and then the flow of the fluid is split by the splitter blades. The gap between the outward edges of these blades and the shroud wall is often set to less than 10% of the height of the blades. However, in a small-sized centrifugal compressor, the gap between the outward edges of the blades and the shroud wall may be relatively large. In such a configuration, since the working fluid leaks through the gap between the outward edges of the blades and the shroud wall (in other words, the working fluid flows over the outward edges of the blades), vortices develop not only in the working fluid that has flowed into the space between the full blades but also in the working fluid that has flowed into the space between the full blade and the splitter blade. The present inventors have found that it is possible to prevent or suppress the above-described two-step development of vortices by bleeding both a portion of the working fluid that has flowed into the space between the full blades and a portion of the working fluid that has flowed into the space between the full blade and the splitter blade. Thereby, the performance of the centrifugal compressor can be enhanced.

It is possible to prevent or suppress the above-described development of vortexes even if only a portion of the working fluid that has flowed into the space between the full blade and the splitter blade. It is also possible to prevent or suppress the above-described development of vortexes even if only a portion of the working fluid that has flowed into the space between the full blades. The technique disclosed in this description has been made from this point of view.

The first aspect of the present disclosure provides a centrifugal compressor that compresses a working fluid, including: an impeller having alternately arranged full blades and splitter blades, the splitter blades being shorter than the full blades; a shroud wall forming an intake and having a shape conforming to the impeller; and a bleed chamber that communicates with a discharge space having a pressure equal to or lower than a pressure of the working fluid at the intake, the bleed chamber facing an outer surface of the shroud wall, wherein the shroud wall is provided with a bleeding passage that directs a portion of the working fluid that has flowed into a space between the full blade and a pressurizing surface of the splitter blade to the bleed chamber, and in a meridional projection obtained by rotationally projecting the full blade, the splitter blade, and the shroud wall on a meridian plane passing through a rotational axis of the impeller, a point of intersection of an upstream edge of the splitter blade and an outward edge of the splitter blade is located at a position closer to the intake than an intake-side edge of an opening of an inlet of the bleeding passage.

According to the first aspect, it is possible to bleed a portion of the working fluid that has flowed into the space between the full blade and the pressurizing surface of the splitter blade through the bleeding passage so as to prevent or suppress the development of vortices caused by the leakage of the working fluid through the gap between the outward edge of the splitter blade and the shroud wall. Thereby, the performance of the centrifugal compressor can be enhanced. In the case where the inlet of the bleeding passage is located at the position as described above, the portion of the working fluid that has flowed into the space between the full blade and the pressurizing surface of the splitter blade can be directed to the bleed chamber efficiently.

In the vicinity of the upstream edge of the full blade, there is no large difference between the pressure of the working fluid on the pressurizing surface of the full blade and the pressure of the working fluid on the non-pressurizing surface of the full blade. On the other hand, by the time the working fluid reaches the splitter blade, a relatively large difference is made between the pressure of the working fluid on the pressurizing surface of the full blade and the pressure of the working fluid on the non-pressurizing surface of the full blade. Therefore, the phenomenon in which the working fluid flows over the outward edges of the blades is more likely to occur in the splitter blades than in the full blades. In view of this, the performance of the centrifugal compressor can be enhanced effectively by forming the bleeding passage (slit) so as to direct the portion of the working fluid that has flowed into the space between the full blade and the pressurizing surface of the splitter blade to the bleed chamber.

A second aspect provides the centrifugal compressor as set forth in the first aspect, wherein the shroud wall is further provided with an additional bleeding passage that directs a portion of the working fluid that has flowed into a space between the adjacent full blades to the bleed chamber, and in the meridional projection, a point of intersection of an upstream edge of the full blade and an outward edge of the full blade is located at a position closer to the intake than an intake-side edge of an opening of an inlet of the additional bleeding passage. In the case where the inlet of the additional bleeding passage is located at the position as described above, the portion of the working fluid that has flowed into the space between the full blades can be directed to the bleed chamber efficiently.

A third aspect provides the centrifugal compressor as set forth in the second aspect, wherein a length of the additional bleeding passage in a circumferential direction of the shroud wall is shorter than a distance between the adjacent full blades at a position where the additional bleeding passage opens toward the impeller. This configuration makes it possible to avoid the simultaneous presence of the outward edges of two full blades over one additional bleeding passage and thus to cause each of the full blades to sweep the working fluid smoothly into the additional bleeding passage.

A fourth aspect provides the centrifugal compressor as set forth in the second or the third aspect, wherein in the meridional projection, the inlet of the additional bleeding passage is located at a distance ranging from 0.02 L1 to 0.4 L1 from the upstream edge of the full blade when a projected length of the outward edge of the full blade is defined as L1. In the case where the inlet of the additional bleeding passage is located at the position in this range, it is possible to prevent or suppress the development of vortices very effectively.

A fifth aspect provides the centrifugal compressor as set forth in any one of the second to fourth aspects, wherein the shroud wall is provided with a plurality of the bleeding passages and a plurality of the additional bleeding passages, and the bleeding passages and the additional bleeding passages are alternately arranged in a staggered manner in a circumferential direction of the shroud wall. This configuration makes it possible to efficiently bleed both the portion of the working fluid that has flowed into the space between the full blades and the portion of the working fluid that has flowed into the space between the full blade and the splitter blade.

A sixth aspect provides the centrifugal compressor as set forth in any one of the second to fifth aspects, wherein the number of the additional bleeding passages is equal to that of the full blades, and the additional bleeding passages are arranged at the same angular pitch as the full blades. This configuration makes it possible to avoid the simultaneous presence of the outward edges of two full blades over one additional bleeding passage and thus to cause each of the full blades to sweep the working fluid smoothly into the additional bleeding passage.

A seventh aspect provides the centrifugal compressor as set forth in any one of the first to sixth aspects, wherein a length of the bleeding passage in a circumferential direction of the shroud wall is shorter than a distance between the full blade and the splitter blade at a position where the bleeding passage opens toward the impeller. This configuration makes it possible to avoid the simultaneous presence of the outward edge of the full blade and the outward edge of the splitter blade over one bleeding passage and thus to cause the full blade and the splitter blade to sweep the working fluid smoothly into the bleeding passage.

A eighth aspect provides the centrifugal compressor as set forth in any one of the first to seventh aspects, wherein in the meridional projection, the inlet of the bleeding passage is located at a distance ranging from 0.02 L2 to 0.4 L2 from the upstream edge of the splitter blade when a projected length of the outward edge of the splitter blade is defined as L2. In the case where the inlet of the bleeding passage is located at the position in this range, it is possible to prevent or suppress the development of vortices very effectively.

A ninth aspect provides a refrigeration cycle apparatus including: a main circuit including an evaporator that retains a refrigerant liquid and evaporates the refrigerant liquid therein, a first compressor that compresses a refrigerant vapor, and a condenser that condenses the refrigerant vapor therein and retains the refrigerant liquid, wherein the evaporator, the first compressor, and the condenser are connected in this order; a first circulation path that allows the refrigerant liquid retained in the evaporator or a heat medium cooled in the evaporator to circulate via a heat exchanger for heat absorption; and a second circulation path that allows the refrigerant liquid retained in the condenser or a heat medium heated in the condenser to circulate via a heat exchanger for heat release, wherein the first compressor is the centrifugal compressor according to any one of the first to eighth aspects, and the refrigeration cycle apparatus further includes a return path that returns the refrigerant vapor from the bleed chamber of the centrifugal compressor to the evaporator.

According to the ninth aspect, the refrigerant vapor is returned from the bleed chamber of the centrifugal compressor to the evaporator through the return path. Thereby, the performance of the centrifugal compressor can be enhanced, and as a result, the performance of the refrigeration cycle apparatus can be enhanced.

A tenth aspect provides the refrigeration cycle apparatus as set forth in the ninth aspect, wherein the second compressor is a centrifugal compressor, and the first compressor and the second compressor are coupled together by a rotary shaft. The number of components of the first compressor and the second compressor can be reduced by coupling them together by the rotary shaft.

An eleventh aspect provides the refrigeration cycle apparatus as set forth in the ninth or the tenth aspect, wherein the return path is provided with a flow rate regulating valve. The efficiency of the centrifugal compressor can be optimized by regulating the flow rate of the refrigerant vapor by the flow rate regulating valve.

Hereinafter, embodiments of the present invention will be described with reference to the drawings. The present invention is not limited to the following embodiments.

Embodiments

Figure 2:
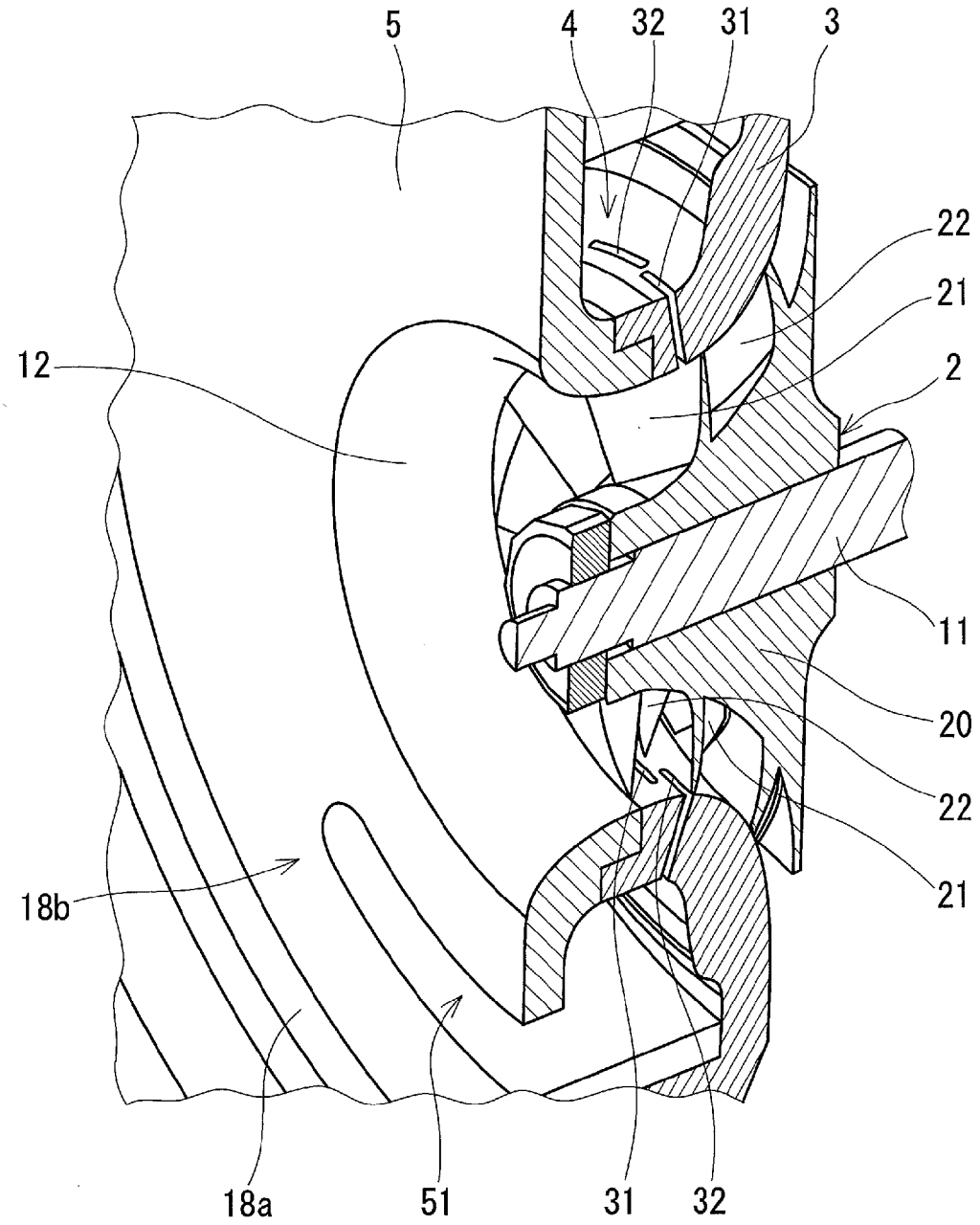
FIG. 2 is a partial perspective cross-sectional view of the centrifugal compressors shown in FIG. 1.

FIG. 1 and FIG. 2 show a centrifugal compressor 1A according to an embodiment of the present invention. The centrifugal compressor 1A is coupled to an electric motor or to a turbine and a generator via a rotary shaft 11. The centrifugal compressor 1A is driven by the rotation of the rotary shaft 11 and compresses a working fluid.

Specifically, the centrifugal compressor 1A includes an impeller 2 fixed to the rotary shaft 11, a back plate 13 disposed behind the impeller 2, and a housing 15 in which the impeller 2 is mounted. Hereinafter, for convenience of description, being directed to or being located on the front surface side of the back plate 13 and the back surface side thereof along the axial direction of the rotary shaft 11 may be referred to as "forward or ahead of" and "backward or behind", respectively.

Figure 3:
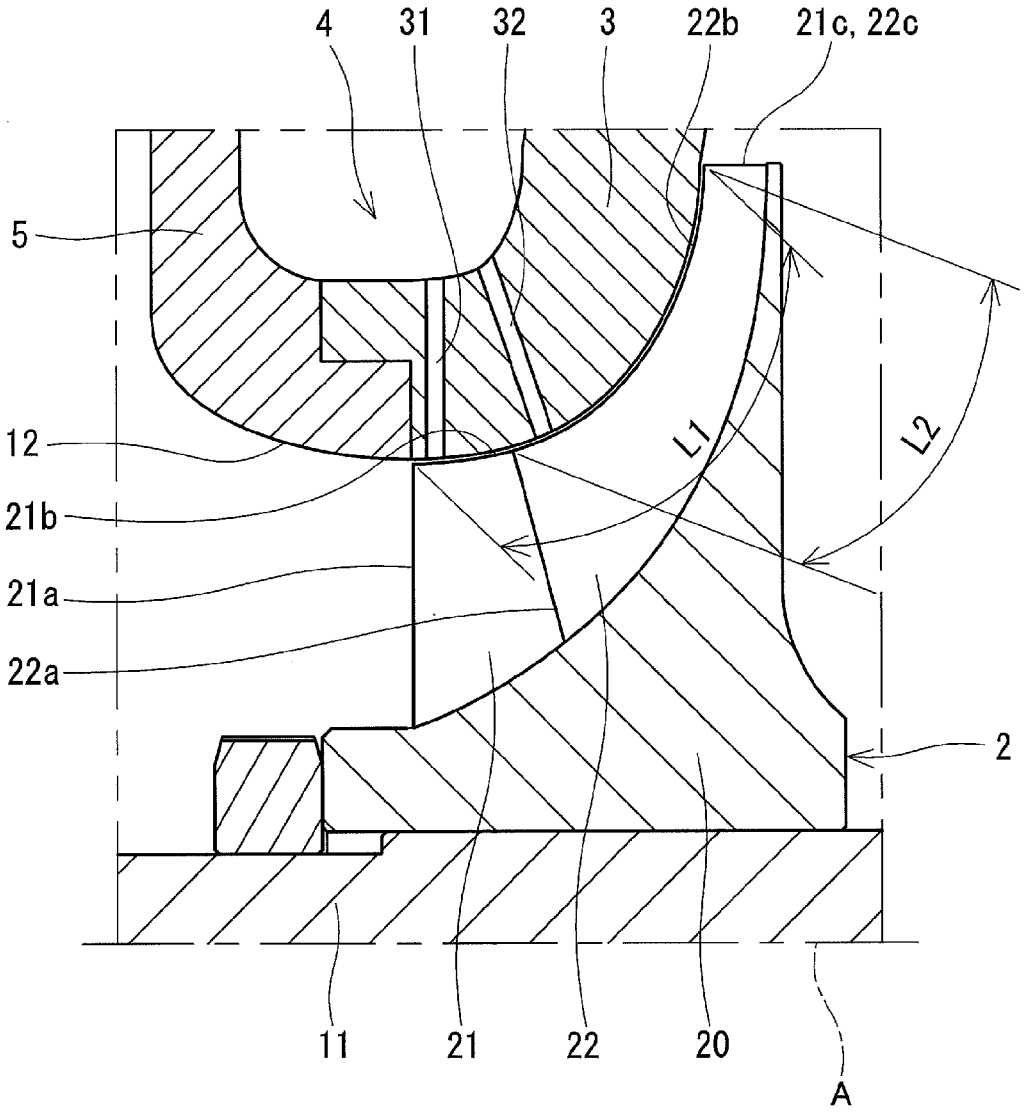
FIG. 3 is a diagram for explaining the positional relationship between a full blade and a first slit and the positional relationship between a splitter blade and a second slit on a meridian plane.

The impeller 2 includes: a main body 20 whose diameter gradually increases from the smallest diameter portion to the largest diameter portion along the axial direction of the rotary shaft 11; and full blades 21 and splitter blades 22 extending from the flared outer peripheral surface of the main body 20. The full blades 21 and the splitter blades 22 are arranged alternately in the circumferential direction of the impeller 2. The splitter blade 22 is shorter than the full blade 21, and as shown in FIG. 3, the downstream edge 22*c* of the splitter blade 22 is located at the same position as the downstream edge 21*c* of the full blade 21, while the upstream edge 22*a* of the splitter blade 22 is located behind the upstream edge 21*a* of the full blade 21. In each of the full blades 21 and the splitter blades 22, the surface facing in the rotational direction of the impeller 2 is a pressurizing surface, and the surface opposite to the pressurizing surface is a non-pressurizing surface.

The housing 15 includes: a shroud wall 3 having a shape conforming to the impeller 2; a flange 5 extending radially outwardly from the front end of the shroud wall 3; a peripheral member 17 connected to the rear end of the shroud wall 3; and a front member 18 interposed between the peripheral member 17 and the flange 5. The shroud wall 3 extends forward beyond the impeller 2 so as to form an intake 12, and the peripheral member 17 forms a volute chamber 16 around the impeller 2. The volute chamber 16 communicates with a diffuser formed between the back plate 13 and the shroud wall 3. In the present embodiment, the shroud wall 3 is divided into a front part and a rear part near the upstream edge 21*a* of the full blade 21 of the impeller 2, the front part of the shroud wall 3 and the flange 5 are integrated into a single unit, and the rear part of the shroud wall 3 and the peripheral member 17 are integrated into a single unit.

FIG. 3 is a meridional projection (rotational projection) obtained by rotationally projecting the full blade 21, the splitter blade 22, and the shroud wall 3 on a meridian plane passing through the rotational axis A of the impeller 2. The shape represented in the meridional projection is referred to as a "meridional shape" in the field of turbomachinery. In this description, the outer peripheral edge of the full blade 21 facing the intake 12 is defined as the upstream edge 21*a* of the full blade 21. The outer peripheral edge of the full blade 21 facing the shroud wall 3 is defined as the outward edge 21*b* of the full blade 21. Likewise, the outer peripheral edge of the splitter blade 22 facing the intake 12 is defined as the upstream edge 22*a* of the splitter blade 22. The outer peripheral edge of the splitter blade 22 facing the shroud wall 3 is defined as the outward edge 22*b* of the splitter blade 22.

The front member 18 and the flange 5 cover the space facing the outer surface of the shroud wall 3. That is, the shroud wall 3, the flange 5, and the front member 18 form an annular bleed chamber 4 around the intake 12. The front member 18 has a tubular surface 18*a* extending forward beyond the flange 5. The tubular surface 18*a* forms a ring-shaped space (corresponding to a discharge space of the present invention) 18*b* facing the front surface of the flange 5 and communicating with the intake 12. Since the ring-shaped space 18*b* is filled with the working fluid, the ring-shaped space 18*b* has the same pressure as that of the working fluid at the intake 12. As used herein, "the same pressure" refers to a concept including not only a state in which the pressure of the ring-shaped space 18*b* is exactly equal to the pressure of the working fluid at the intake 12 but also a state in which the pressure of the former is higher than the pressure of the latter by the loss of pressure.

The flange 5 is provided with an arcuate opening 51, and the bleed chamber 4 communicates with the ring-shaped space 18*b* through this opening 51.

The shroud wall 3 is provided with a plurality of first slits 31 (additional bleeding passages) and a plurality of second slits 32 (bleeding passages) each extending in the circumferential direction. The first slit 31 opens into the bleed chamber 4 and the space near the upstream edge 21*a* of the full blade 21 of the impeller 2. The second slit 32 opens into the bleed chamber 4 and the space near the upstream edge 22*a* of the splitter blade 22. The first slits 31 and the second slits 32 are alternately arranged in a staggered manner in the circumferential direction. The first slits 31 and the second slits 32 need not necessarily be exactly parallel to the circumferential direction, and they may be slightly inclined from the circumferential direction.

The first slit 31 directs a portion of the working fluid that has flowed into the space between the adjacent full blades 21 to the bleed chamber 4. The second slit 32 directs a portion of the working fluid that has flowed into the space between the full blade 21 and the pressurizing surface of the splitter blade 22 to the bleed chamber 4. For example, the number of the first slits 31 is equal to the number of the full blades 21, and the first slits 31 and the full blades 21 are arranged at the same angular pitch. This configuration makes it possible to avoid the simultaneous presence of the outward edges 21*b* of two full blades 21 over one first slit 31 and thus to cause each of the full blades 21 to sweep the working fluid smoothly into the first slit 31.

Figure 4:
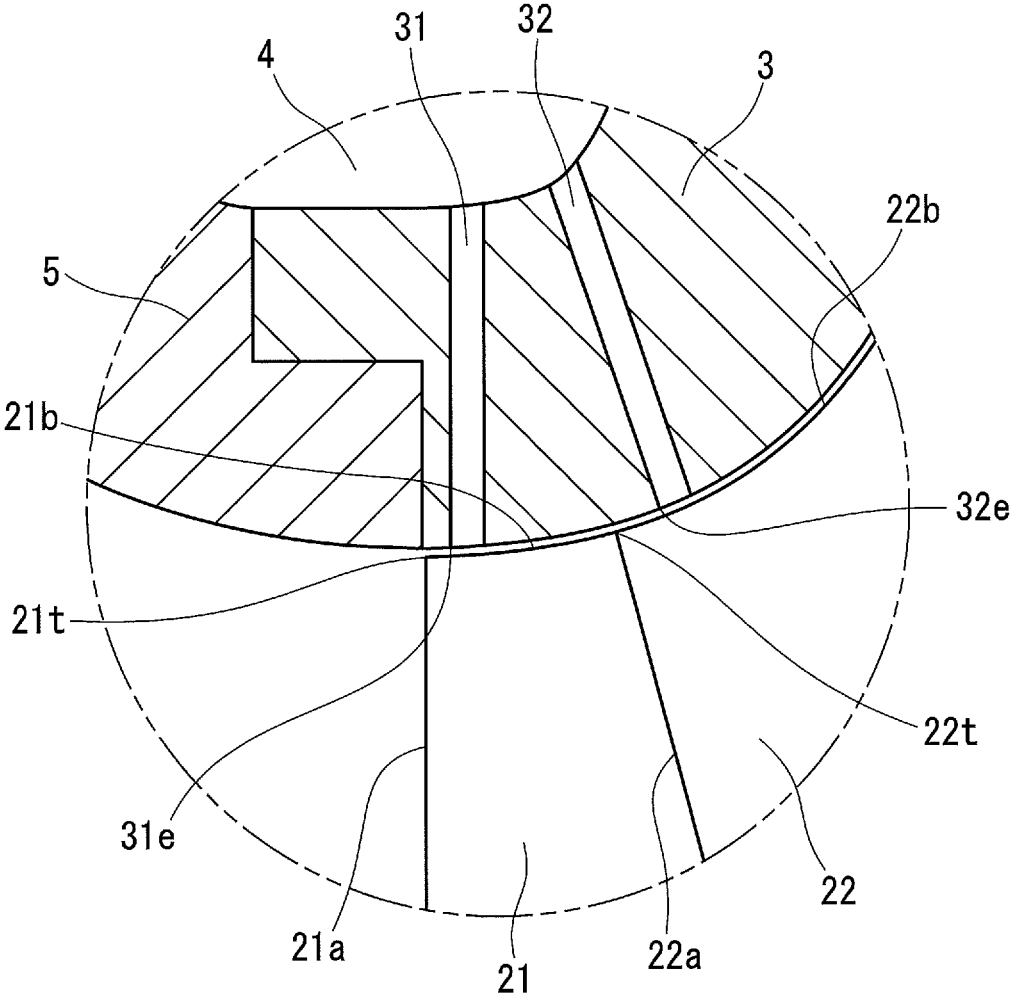
FIG. 4 is a partially enlarged view of FIG. 3.

As shown in FIG. 3 and FIG. 4, the first slit 31 opens at a position behind the upstream edge 21*a* of the full blade 21 and ahead of the upstream edge 22*a* of the splitter blade 22 in the axial direction of the rotary shaft 11. Specifically, as shown in FIG. 4, in the meridional projection, a point of intersection 21*t* of the upstream edge 21*a* of the full blade 21 and the outward edge 21*b* of the full blade 21 is located at a position closer to the intake 12 than the intake-side edge 31*e* of the opening of the inlet of the first slit 31. In the present embodiment, the entire inlet of the first slit 31 faces the outward edge 21*b* of the full blade. In the case where the inlet of the first slit 31 is located at such a position, a portion of the working fluid that has flowed into the space between the full blades 21 can be directed to the bleed chamber 4 efficiently.

The second slit 32 opens at a position behind the upstream edge 22*a* of the splitter blade 22 in the axial direction of the rotary shaft 11. Specifically, as shown in FIG. 4, in the meridional projection, a point of intersection 22*t* of the upstream edge 22*a* of the splitter blade 22 and the outward edge 22*b* of the splitter blade 22 is located at a position closer to the intake 12 than the intake-side edge 32*e* of the opening of the inlet of the second slit 32. In the present embodiment, the entire inlet of the second slit 32 faces the outward edge 22*b* of the splitter blade 22. In the case where the inlet of the second slit 32 is located at such a position, a portion of the working fluid that has flowed into the space between the full blade 21 and the pressurizing surface of the splitter blade 22 can be directed to the bleed chamber 4 efficiently.

It is desirable that the length of the first slit 31 in the circumferential direction of the shroud wall 3 be shorter than the distance between the adjacent full blades 21 at a position where the first slit 31 opens towards the impeller 2. This is because this configuration makes it possible to avoid the simultaneous presence of the outward edges 21*b* of two full blades 21 over one first slit 31 and thus to cause each of the full blades 21 to sweep the working fluid smoothly into the first slit 31. From the same point of view, it is desirable that the length of the second slit 32 in the circumferential direction of the shroud wall 3 be shorter than the distance between the full blade 21 and the splitter blade 22 at a position where the second slit 32 opens towards the impeller 2.

As shown in FIG. 3, on the meridian plane passing through the rotational axis A of the impeller 2 (the central axis of the rotary shaft 11), the inlet of the first slit 31 (the opening on the impeller 2 side) is located at a distance ranging, for example, from 0.02 L1 to 0.4 L1 (or from 0.05 L1 to 0.1 L1) from the upstream edge 21*a* of the full blade 21, when the projected length of the outward edge 21*b* of the full blade 21 is defined as L1. On the other hand, the inlet of the second slit 32 (the opening on the impeller 2 side) is located at a distance ranging, for example, from 0.02 L2 to 0.4 L2 (or from 0.05 L2 to 0.1 L2) from the upstream edge 22*a* of the splitter blade 22, when the projected length of the outward edge 22*b* of the splitter blade 22 is defined as L2. The width of the first slit 31 is, for example, three to five times the thickness of the full blade 21 at a position where the full blade 21 faces the first slit 31. Likewise, the width of the second slit 32 is, for example, three to five times the thickness of the splitter blade 22 at a position where the splitter blade 22 faces the second slit 32. As used herein, the term "projected length" refers to the length of the arc formed by the outward edge 21*b* or 22*b* in the meridional projection in FIG. 3.

In the centrifugal compressor 1A described above, it is possible to bleed a portion of the working fluid that has flowed into the space between the full blades 21 through the first slit 31 so as to prevent or suppress the development of vortices caused by the leakage of the working fluid through the gap between the outward edges 21*b* of the full blades 21 and the shroud wall 3. It is also possible to bleed a portion of the working fluid that has flowed into the space between the full blade 22 and the pressurizing surface of the splitter blade 22 through the second slit 32 so as to prevent or suppress the development of vortices caused by the leakage of the working fluid through the gap between the outward edges 22*b* of the splitter blades 22 and the shroud wall 3. Thereby, the performance of the centrifugal compressor 1A can be enhanced.

Vortices caused by the leakage of the working fluid through the gap between the outward edges of the blades and the shroud wall are often formed immediately downstream of the upstream edges of the blades. For this reason, when the opening (inlet) of the first slit 31 is located at a distance ranging from, for example, 0.02 L1 to 0.4 L1 (or 0.05 L1 to 0.1 L1) from the upstream edge 21*a* of the full blade 21, it is possible to prevent or suppress the development of such vortices very effectively. Likewise, when the opening (inlet) of the second slit 32 is located at a distance ranging from, for example, 0.02 L2 to 0.4 L2 (or 0.05 L2 to 0.1 L2) from the upstream edge 22*a* of the splitter blade 22, it is possible to prevent or suppress the development of such vortices very effectively.

(Modification)

Figure 5:
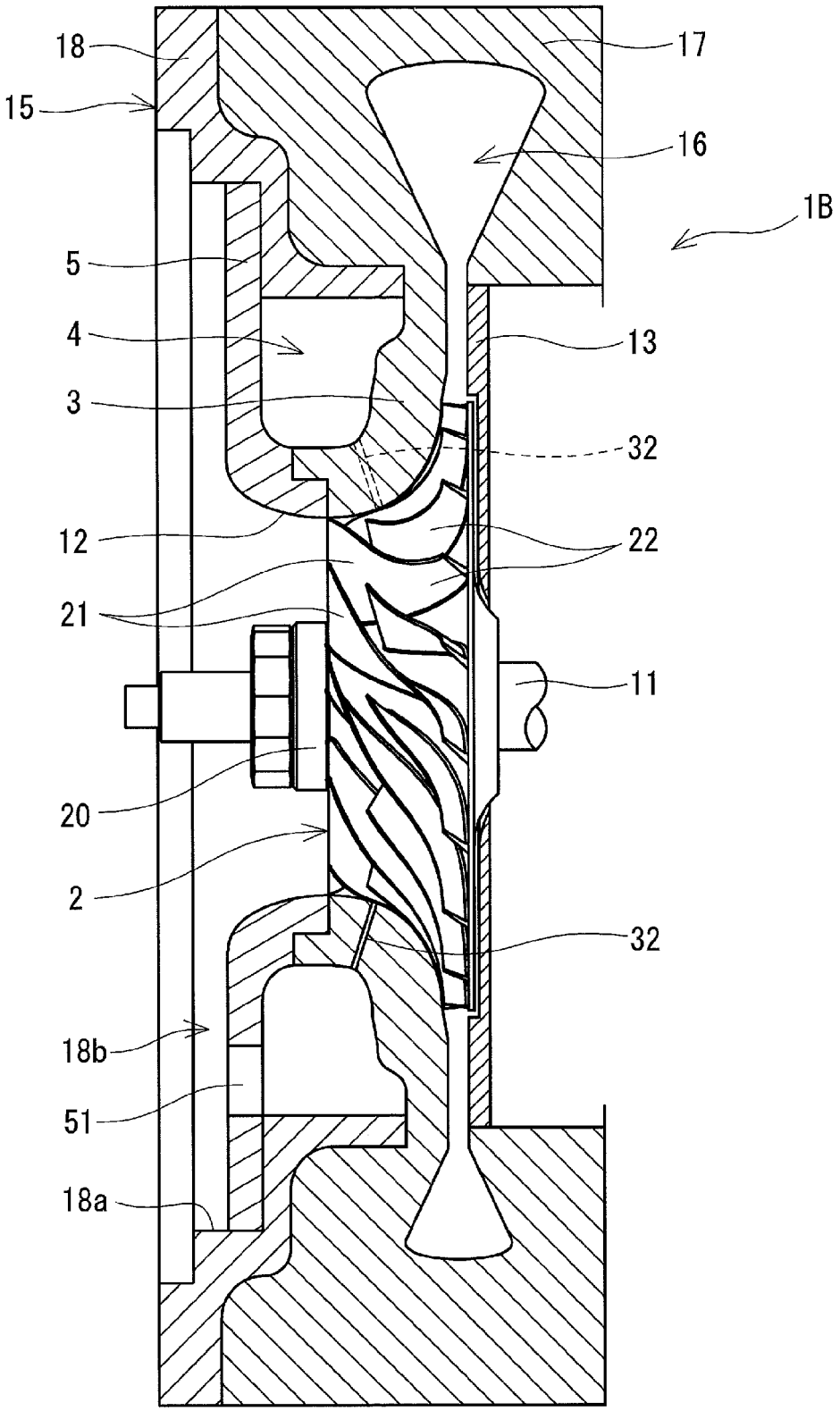
FIG. 5 is a cross-sectional view of a centrifugal compressor according to a modification.

As shown in FIG. 5, a centrifugal compressors 1B according to a modification has the same configuration as the centrifugal compressor 1A described above with reference to FIGS. 1 to 4, except that the shroud wall 3 is not provided with the first slit 31. The shroud wall 3 is provided with at least one second slit 32 as a bleeding passage that directs a portion of the working fluid to the bleed chamber 4. The description of the centrifugal compressor 1A is applicable to the other parts of the centrifugal compressor 1B.

In the vicinity of the upstream edge 21*a* of the full blade 21, there is no large difference between the pressure of the working fluid on the pressurizing surface of the full blade 21 and the pressure of the working fluid on the non-pressurizing surface of the full blade 21. On the other hand, by the time the working fluid reaches the splitter blade 22, a relatively large difference is made between the pressure of the working fluid on the pressurizing surface of the full blade 21 and the pressure of the working fluid on the non-pressurizing surface of the full blade 21. Therefore, the phenomenon in which the working fluid flows over the outward edges of the blades is more likely to occur in the splitter blades 22 than in the full blades 21. In view of this, the performance of the centrifugal compressor 1B can be enhanced effectively by forming the bleeding passage (slit 32) so as to direct the portion of the working fluid that has flowed into the space between the full blade 21 and the pressurizing surface of the splitter blade 22 to the bleed chamber 4.

(Other Modifications)

In the above-described embodiment, a plurality of first slits 31 and a plurality of second slits 32 are provided. One first slit 31 and one second slit 32 may be provided.

The cross-sectional shape of the bleeding passage that directs the portion of the working fluid to the bleed chamber 4 is not particularly limited. For example, instead of the first slit 31, a through-hole having another cross-sectional shape, such as a circle, an ellipse, or a rectangle, may be provided. The bleeding passages having different cross-sectional shapes from each other may be formed in the shroud wall 3 along the circumferential direction thereof. The same applies to the second slit 32.

In the above-described embodiment, through the opening 51 provided in the flange 5, the bleed chamber 4 communicates with the ring-shaped space 18*b* communicating with the intake 12. However, the bleed chamber 4 may communicate with a space having a pressure lower than the pressure of the working fluid at the intake 12. For example, the bleed chamber 4 may communicate with a negative pressure source (for example, the intake side of another compressor) disposed separately from the centrifugal compressor 1A or 1B, through a flow path penetrating the housing 15.

(Examples of Application)

Figure 6:
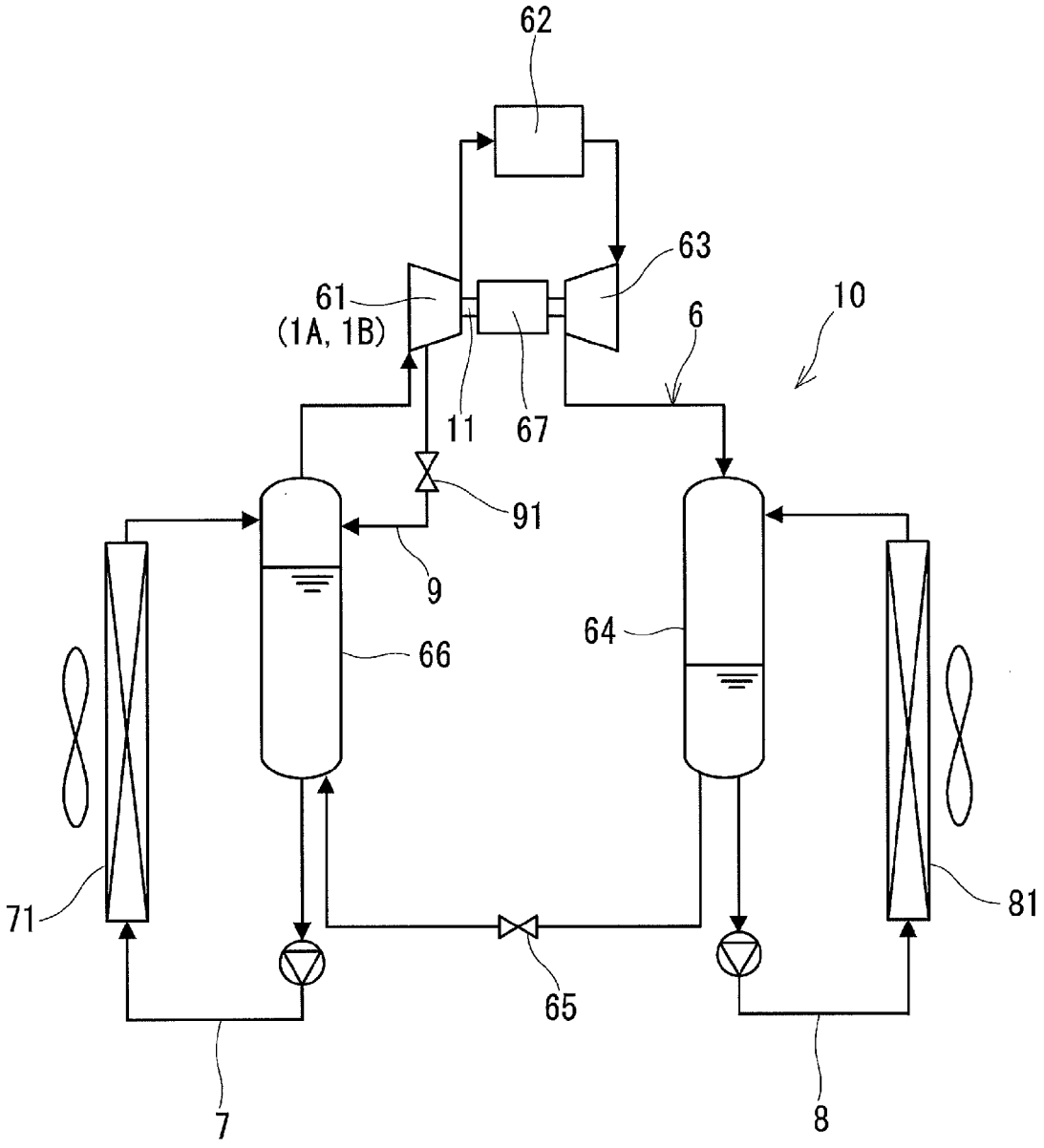
FIG. 6 is a configuration diagram of a refrigeration cycle apparatus in which the centrifugal compressor shown in FIG. 1
Figure 7:
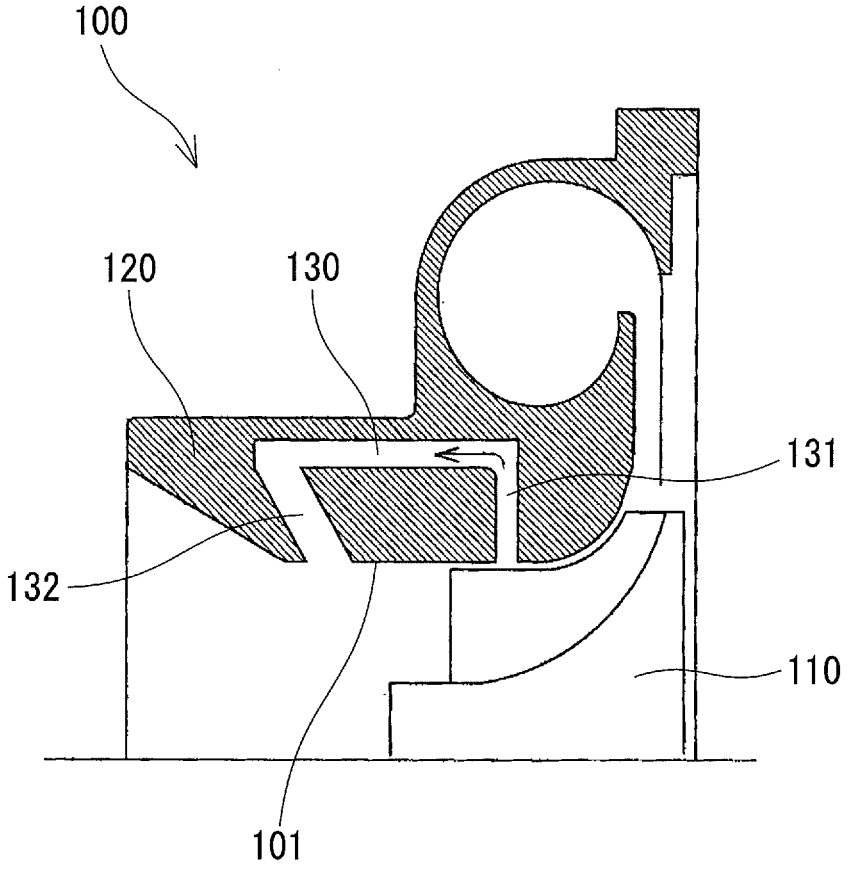
FIG. 7 is a cross-sectional view of a conventional centrifugal compressor.

The applications of the above-described centrifugal compressors 1A and 1B are not particularly limited. They may be used in stationary gas turbine generators, or gas turbine generators to be mounted in vehicles such as automobiles. Instead, the centrifugal compressors 1A and 1B can be used in, for example, a refrigeration cycle apparatus 10 as shown in FIG. 6.

The refrigeration cycle apparatus 10 includes: a main circuit 6 that allows a refrigerant to circulate; a first circulation path 7 for heat absorption; and a second circulation path 8 for heat release. The main circuit 6, the first circulation path 7, and the second circulation path 8 are filled with a refrigerant in the form of liquid at ordinary temperature. More specifically, a refrigerant whose saturated vapor pressure is a negative pressure at ordinary temperature is used as the refrigerant. Examples of such a refrigerant include refrigerants whose main component is water or alcohol. The pressure in each of the main circuit 6, the first circulation path 7, and the second circulation path 8 is a negative pressure lower than the atmospheric pressure. In this description, the term "main component" refers to a component whose content is the highest in mass ratio.

The main circuit 6 includes an evaporator 66, a first compressor 61, an intercooler 62, a second compressor 63, a condenser 64, and an expansion valve 65, and these devices are connected in this order by flow paths.

The evaporator 66 retains a refrigerant liquid, and evaporates the refrigerant liquid therein. Specifically, the refrigerant liquid retained in the evaporator 66 is circulated via a heat exchanger for heat absorption 71 through the first circulation path 7. For example, in the case where the refrigeration cycle apparatus 10 is an air conditioner for cooling an indoor space, the heat exchanger for heat absorption 71 is placed in the indoor space, and cools the indoor air supplied by an air blower through heat exchange with the refrigerant liquid.

The refrigerant vapor is compressed in two stages by the first compressor 61 and the second compressor 63. The above-described centrifugal compressor 1A or 1B is used as the first compressor 61. The second compressor 63 may be a positive displacement compressor independent of the first compressor 61. However, in the present embodiment, the second compressor 63 is a centrifugal compressor coupled with the first compressor 61 by a rotary shaft 11. An electric motor 67 that rotates the rotary shaft 11 may be disposed between the first compressor 61 and the second compressor 63, or may be disposed outside one of these compressors. The number of components of the first compressor 61 and the second compressor 63 can be reduced by coupling them together by the rotary shaft 11.

The intercooler 62 cools the refrigerant vapor discharged from the first compressor 21 before the refrigerant vapor is drawn into the second compressor 22. The intercooler 62 may be a direct contact heat exchanger, or an indirect heat exchanger.

The condenser 64 condenses the refrigerant vapor therein, and retains the refrigerant liquid. Specifically, the refrigerant liquid retained in the condenser 64 is circulated via a heat exchanger for heat release 81 through the second circulation path 8. For example, in the case where the refrigeration cycle apparatus 10 is an air conditioner for cooling an indoor space, the heat exchanger for heat release 81 is placed outside the indoor space, and heats outdoor air supplied by an air blower through heat exchange with the refrigerant liquid.

The refrigeration cycle apparatus 10 need not necessarily be an air conditioner designed specifically for cooling. For example, if a first heat exchanger placed in an indoor space and a second heat exchanger placed outside the indoor space are connected to the evaporator 66 and the condenser 64 via four-way valves, an air conditioner capable of switching between cooling operation and heating operation can be obtained. In this case, both the first heat exchanger and the second heat exchanger function as the heat exchanger for heat absorption 71 and the heat exchanger for heat release 81. In addition, the refrigeration cycle apparatus 10 need not necessarily be an air conditioner, and may be, for example, a chiller. Furthermore, the object to be cooled in the heat exchanger for heat absorption 71 and the object to be heated in the heat exchanger for heat release 81 may be a gas other than air or a liquid.

The expansion valve 65 is one example of a pressure-reducing mechanism that reduces the pressure of the refrigerant liquid resulting from condensation. However, the pressure-reducing mechanism is not limited to the expansion valve 65 provided in the main circuit 6. For example, a configuration designed to make the level of the refrigerant liquid in the evaporator 66 higher than the level of the refrigerant liquid in the condenser 64 may be employed.

In the configuration shown in FIG. 6, the bleed chamber 4 (see FIGS. 1 to 4) of the centrifugal compressor 1A or 1B communicates with the inner space of the evaporator 66 through the return path 9. That is, the inner space of the evaporator 66 corresponds to the discharge space of the present invention. Therefore, the refrigerant vapor is returned from the bleed chamber 4 of the centrifugal compressor 1A or 1B to the evaporator 66 through the return path 9. Thereby, the performance of the centrifugal compressor 1A or 1B can be enhanced, and as a result, the performance of the refrigeration cycle apparatus 10 can be enhanced. Desirably, the return path 9 is provided with a flow rate regulating valve 91. The efficiency of the centrifugal compressor 1A or 1B can be optimized by regulating the flow rate of the refrigerant vapor by the flow rate regulating valve 91.

The evaporator 66 need not necessarily be a direct contact heat exchanger, and it may be an indirect heat exchanger. In this case, a heat medium cooled in the evaporator 66 circulates through the first circulation path 7. Likewise, the condenser 64 need not necessarily be a direct contact heat exchanger, and it may be an indirect heat exchanger. In this case, a heat medium heated in the condenser 64 circulates through the second circulation path 8.

The invention claimed is:

1. A centrifugal compressor that compresses a working fluid, comprising:

an impeller comprising alternately arranged full blades and splitter blades, the splitter blades being shorter than the full blades;

a shroud wall forming an intake and having a shape conforming to the impeller; and a bleed chamber that communicates with a discharge space having a pressure equal to or lower than a pressure of the working fluid at the intake, the bleed chamber facing an outer surface of the shroud wall, wherein the shroud wall is provided with a bleeding passage that directs a portion of the working fluid that has flowed into a space between the full blade and a pressurizing surface of the splitter blade to the bleed chamber, in a meridional projection obtained by rotationally projecting the full blade, the splitter blade, and the shroud wall on a meridian plane passing through a rotational axis of the impeller, a point of intersection of an upstream edge of the splitter blade and an outward edge of the splitter blade is located at a position closer to the intake than an intake-side edge of an opening of an inlet of the bleeding passage, the shroud wall is further provided with an additional bleeding passage that directs a portion of the working fluid that has flowed into a space between the adjacent full blades to the bleed chamber, and in the meridional projection, a point of intersection of an upstream edge of the full blade and an outward edge of the full blade is located at a position closer to the intake than an intake-side edge of an opening of an inlet of the additional bleeding passage.

2. The centrifugal compressor according to claim 1, wherein a length of the additional bleeding passage in a circumferential direction of the shroud wall is shorter than a distance between the adjacent full blades at a position where the additional bleeding passage opens toward the impeller.

3. The centrifugal compressor according to claim 1, wherein in the meridional projection, the inlet of the additional bleeding passage is located at a distance ranging from 0.02 L1 to 0.4 L1 from the upstream edge of the full blade when a projected length of the outward edge of the full blade is defined as L1.

4. The centrifugal compressor according to claim 1, wherein the shroud wall is provided with a plurality of the bleeding passages and a plurality of the additional bleeding passages, and the bleeding passages and the additional bleeding passages are alternately arranged in a staggered manner in a circumferential direction of the shroud wall.

5. The centrifugal compressor according to claim 1, wherein the number of the additional bleeding passages is equal to that of the full blades, and the additional bleeding passages are arranged at the same angular pitch as the full blades.

6. The centrifugal compressor according to claim 1, wherein a length of the bleeding passage in a circumferential direction of the shroud wall is shorter than a distance between the full blade and the splitter blade at a position where the bleeding passage opens toward the impeller.

7. The centrifugal compressor according to claim 1, wherein in the meridional projection, the inlet of the bleeding passage is located at a distance ranging from 0.02 L2 to 0.4 L2 from the upstream edge of the splitter blade when a projected length of the outward edge of the splitter blade is defined as L2.

8. A refrigeration cycle apparatus comprising:

a main circuit comprising an evaporator that retains a refrigerant liquid and evaporates the refrigerant liquid therein, a first compressor that compresses a refrigerant vapor, and a condenser that condenses the refrigerant vapor therein and retains the refrigerant liquid, wherein the evaporator, the first compressor, and the condenser are connected in this order;

a first circulation path that allows the refrigerant liquid retained in the evaporator or a heat medium cooled in the evaporator to circulate via a heat exchanger for heat absorption; and a second circulation path that allows the refrigerant liquid retained in the condenser or a heat medium heated in the condenser to circulate via a heat exchanger for heat release, wherein the first compressor is the centrifugal compressor according to claim 1, and the refrigeration cycle apparatus further comprises a return path that returns the refrigerant vapor from the bleed chamber of the centrifugal compressor to the evaporator.

9. The refrigeration cycle apparatus according to claim 8, further comprising a second compressor, wherein the second compressor is a centrifugal compressor, and the first compressor and the second compressor are coupled together by a rotary shaft.

10. The refrigeration cycle apparatus according to claim 8, wherein the return path is provided with a flow rate regulating valve.

11. The centrifugal compressor according to claim 1, wherein the additional bleeding passage opens at a position between the upstream edge of the full blade and the upstream edge of the splitter blade in an axial direction of the impeller.

* * * * *